US006690998B1

(12) United States Patent
Yuyama

(10) Patent No.: US 6,690,998 B1
(45) Date of Patent: Feb. 10, 2004

(54) MEDICATION PACKING APPARATUS

(75) Inventor: Shoji Yuyama, Toyonaka (JP)

(73) Assignee: Yuyama Mfg. Co., Ltd., Osaka-fu (JP)

( * ) Notice: Subject to any disclaimer, the term of this patent is extended or adjusted under 35 U.S.C. 154(b) by 0 days.

(21) Appl. No.: 09/699,519

(22) Filed: Oct. 31, 2000

(30) Foreign Application Priority Data

Nov. 1, 1999 (JP) ..... 11-311061

(51) Int. Cl.[7] ..... G06F 17/00

(52) U.S. Cl. ..... 700/242; 700/216; 53/154; 193/14; 221/13; 221/252

(58) Field of Search ..... 700/216, 231, 700/242, 243; 221/13, 15, 124, 133, 252, 296; 53/493, 154, 202; 193/29, 4, 14

(56) References Cited

U.S. PATENT DOCUMENTS 3,152,622 A * 10/1964 Rothermel ..... 141/83
4,664,289 A * 5/1987 Shimizu et al. ..... 221/2
4,674,259 A * 6/1987 Hills ..... 53/202
4,870,799 A * 10/1989 Bergerioux ..... 53/55
5,010,929 A * 4/1991 Tisma ..... 414/1
5,097,652 A * 3/1992 Inamura et al. ..... 53/493
5,348,061 A * 9/1994 Riley et al. ..... 141/104
5,481,855 A * 1/1996 Yuyama ..... 53/493
5,671,592 A * 9/1997 Yuyama et al. ..... 53/493
5,720,154 A * 2/1998 Lasher et al. ..... 53/411
5,765,606 A * 6/1998 Takemasa et al. ..... 141/104
5,787,678 A * 8/1998 Koike et al. ..... 53/154
5,875,610 A * 3/1999 Yuyama et al. ..... 53/75
6,050,064 A * 4/2000 Yuyama et al. ..... 53/514
6,119,737 A * 9/2000 Yuyama et al. ..... 414/104
6,170,229 B1 * 1/2001 Kim ..... 53/155
6,170,230 B1 * 1/2001 Chudy et al. ..... 53/168

* cited by examiner

*Primary Examiner*—Khoi H. Tran
(74) *Attorney, Agent, or Firm*—Wenderoth, Lind & Ponack, L.L.P.

(57) ABSTRACT

In the present invention, in order to reliably smoothly recover different kinds of medicines separately and pack them, the apparatus is provided with hoppers 18, 19 with at least two separated passages, and wherein each hopper 18, 19 can feed a different kind of medicine.

5 Claims, 12 Drawing Sheets

(a)

(b)

MEDICATION PACKING APPARATUS

BACKGROUND OF THE INVENTION

The present invention relates to a medicine packing apparatus, particularly to a medicine packing apparatus having a mechanism adapted to feed medicines to a packing section disposed in one place.

Conventionally, there has been produced a medicine packing apparatus that is provided with a plurality of medicine feeders and that can automatically feed medicines in accordance with prescription data. The medicines fed from the medicine feeders are collected in one place through a hopper and then packed by individual dose in a packing section.

However, in the aforementioned medicine packing apparatus, the medicines fed from each medicine feeder are recovered in the same hopper in spite of being many kinds of medicines. Thus, when fine powder of medicines remains in the hopper, the powder has a possibility of adhering to the surface of the medicines that consequently pass through the hopper. For example, when fine powder of pyrazolone medicine adheres to nonpyrazolone medicine, there arises a problem that some patient may have an allergic reaction.

On the other hand, the hopper needs to be disposed in a narrow space between the medicine feeders and the packing section, and therefore, the hopper cannot be formed with a large dimension in a vertical direction. Therefore, in order to increase the number of the medicine feeders, the space necessary for disposing the hoppers has to be extended in a horizontal direction. Thus, recovering the medicines with the single hopper reduces the inclined angle of the inner surface of the hopper, making it difficult to reliably smoothly recover the medicines to pack them.

SUMMARY OF THE INVENTION

Therefore, it is an object of the present invention to provide a medicine packing apparatus that can reliably smoothly recover different kinds of medicines separately and pack them.

As a means to solve the above problems, the present invention provides a medicine packing apparatus which feeds medicines in accordance with prescription data to distribute by individual dose and pack them, wherein the apparatus is provided with hoppers with at least two passages separated, and wherein each hopper can feed a different kind of medicine.

According to this construction, the medicines contained in the medicine feeders can be fed through the different hoppers in accordance with the kind of medicine. Therefore, even if the fine powder of the medicine remains in the hopper, the powder of one medicine never adheres to a different kind of medicine. In addition, even if the medicine feeders are positioned within a wide range (distance) in a horizontal direction, it is possible to make the inclined angle of the inner surface of each hopper large, allowing the medicines to be reliably smoothly directed to the lower opening.

It is preferable that a common hopper is detachably provided between a medicine packing position and each hopper, and that a medicine delivery means for delivering the medicines dropped from the hopper to the common hopper is also provided beneath the lower end of the hopper which can not directly feed the medicine to the common hopper. Thus, even if the medicine feeders are positioned over a wide range (distance) in a horizontal direction to increase the number of the hoppers, it is possible to recover the medicines to distribute and pack them.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

Hereinafter, an embodiment according to the present invention will be explained in accordance with the accompanying drawings.

Figure 1:
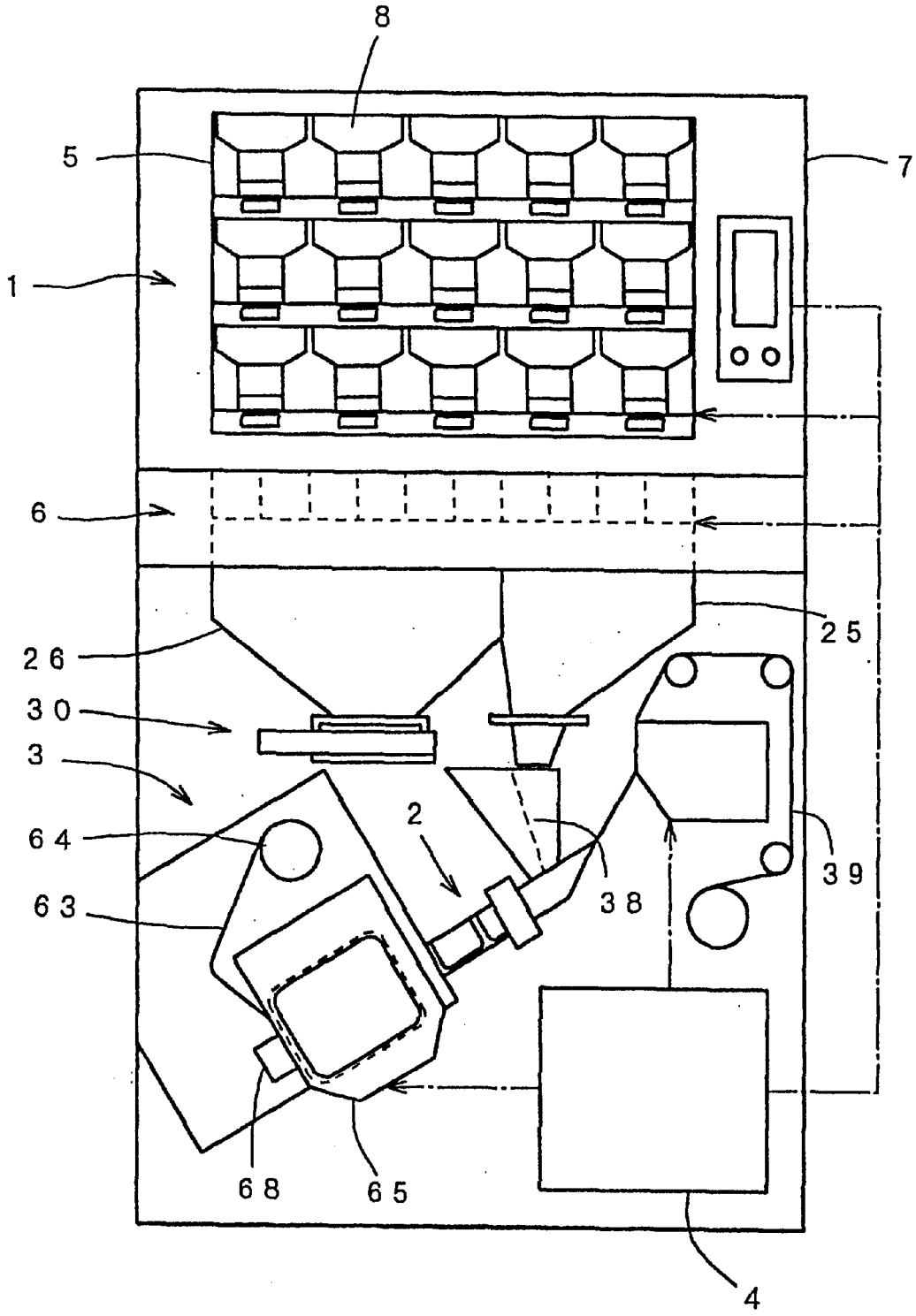
FIG. 1 is a schematic front view of a medicine packing apparatus according to the present invention.

FIG. 1 shows a medicine packing apparatus according to the present embodiment. The medicine packing apparatus comprises a medicine feed section 1, a medicine packing section 2, a medicine package belt binding section 3 and a control section 4 for driving and controlling these sections.

The medicine feed section 1 includes an automatic medicine feed portion 5 and a manual medicine feed portion 6.

The automatic medicine feed portion 5 is provided with a total of 15 medicine feeders 8 of 3 vertically arranged stages by 5 horizontally arranged columns in an upper panel 7. For each column of the medicine feeders 8, medicine passages 16 are formed. The medicine feeders 8 situated at the uppermost position are set at the necessary height for an operator to access them without using a stool.

Figure 2:
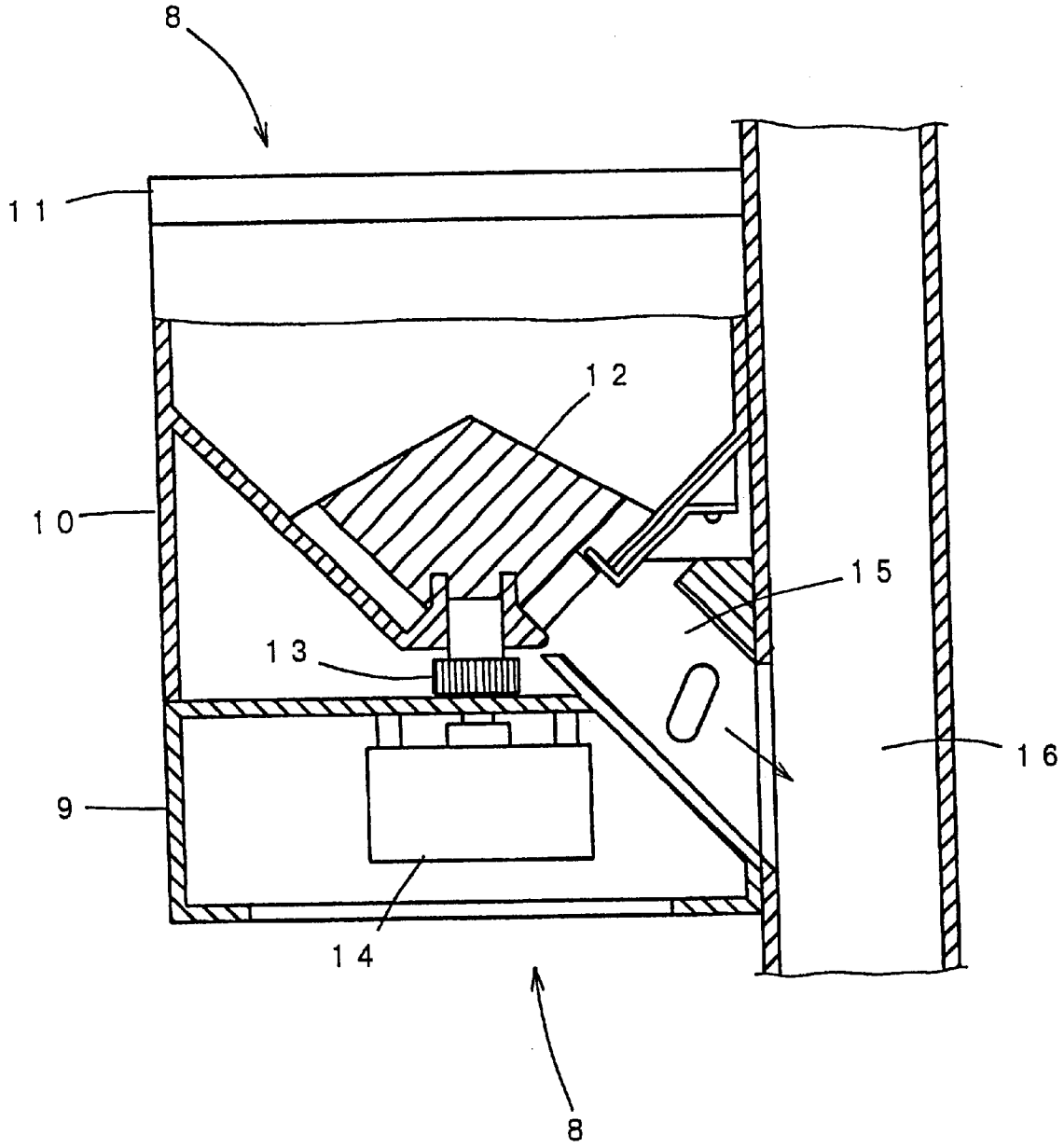
FIG. 2 is a sectional view showing a medicine feeder of FIG. 1.

Each medicine feeder 8, as shown in FIG. 2, comprises a motor base 9 and a feeder vessel 10 detachably mounted on the motor base 8. The feeder vessel 10 has a substantially rectangular shape with an upper opening closed by a cover 11. Each feeder vessel 10 contains a different kind of medicine. In the present embodiment, the feeder vessels 10 in 2 columns on the right side contain pyrazolone medicines, while the feeder vessels 10 in 3 columns on the left side contain nonpyrazolone medicines. On the bottom of each feeder vessel 10 is rotatably provided a rotor 12. The rotor 12 is rotated through a gear 13 by a motor 14 in the motor base 9. Then the rotor 12 discharges the medicines contained in the feeder vessel 10 one by one through a drop guide passage 15 to the medicine passage 16.

Figure 3:
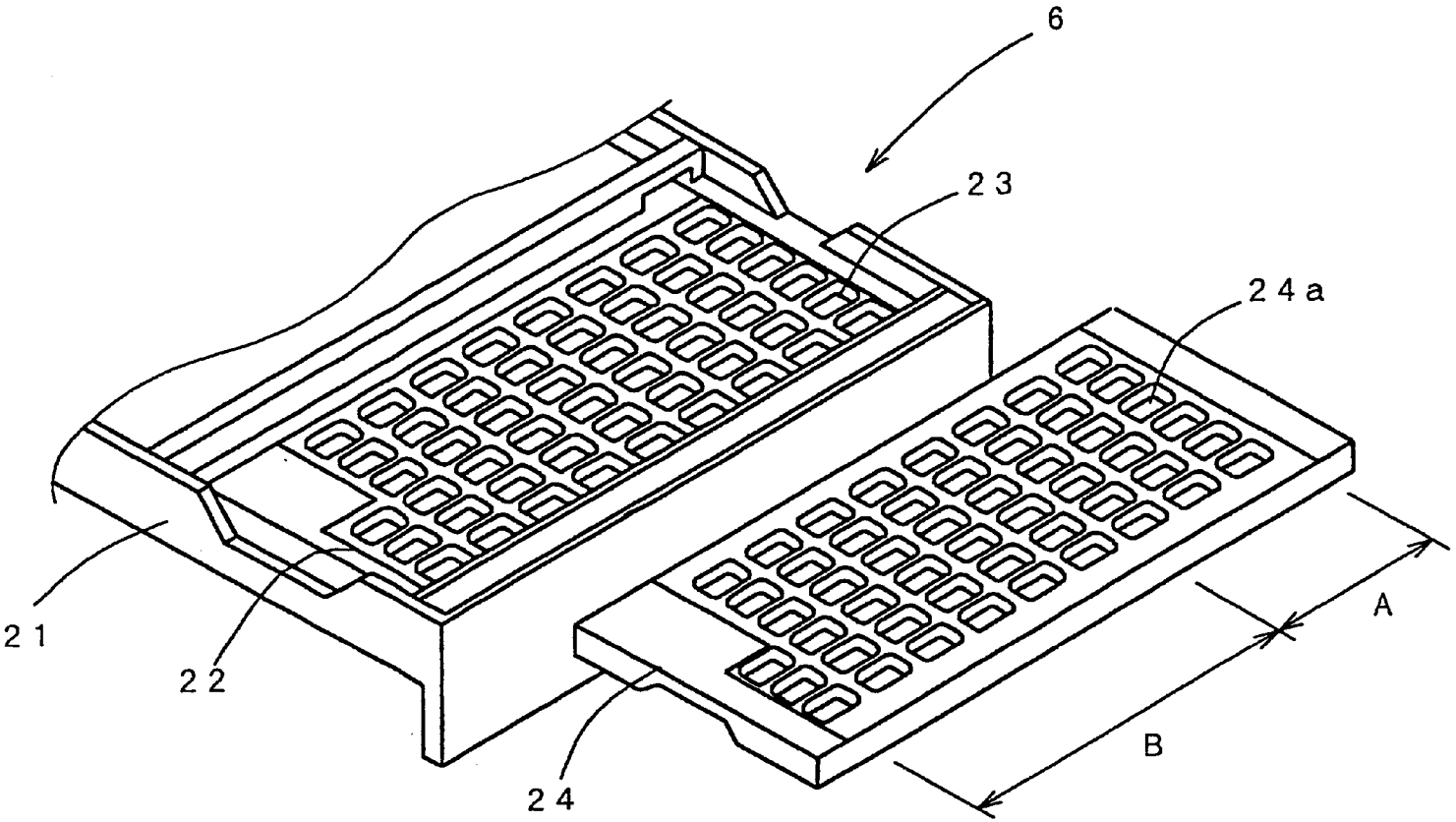
FIG. 3 is an exploded perspective view showing a manual medicine feed section of FIG. 1.

The manual medicine feed portion 6 is arranged to feed medicines (medicines having little chance of being dispensed or medicines having a quantity of broken pieces such as half-tablets or the like) that are not contained in the medicine feeders 8 of the automatic medicine feed portion 5 (for details, refer to Japanese Patent publication 6-37202). As shown in FIG. 3, the manual medicine feed portion 6 is provided with a tablet bucket 22 on a support frame 21. The tablet bucket 22 is formed with a plurality of distributor boxes 23 by partitioning the tablet bucket 22 like a grating. The manual medicine feed portion 6 is provided with a tablet tray 24 having a plurality of distributor boxes 24*a* with the same construction as the tablet bucket 22. The medicines contained in the tablet tray 24 in advance are simultaneously supplied to each distributor box 23. The different kinds of medicines are supplied to the distributor boxes 23 in an area A and an area B of the tablet bucket 22. In the present embodiment, the distributor boxes 23 in the area A are supplied with pyrazolone medicines, while the distributor boxes 23 in the area B are supplied with nonpyrazolone medicines. The bottom of each distributor box 23 is opened in order of position from the distributor box 23 positioned at one end. The operator has to distribute a necessary number of required tablets by hand (manual distribution) in consideration of the order of opening of the distributor box 23. The position of the manual medicine feed portion 6 is set at such a height that the operator can easily carry out the manual distribution of the medicines in each distributor box 23.

Beneath the medicine feed section 2, as shown in FIG. 1, a first hopper 25 and a second hopper 26 are disposed. Each hopper 25, 26 has the shape of a substantially truncated pyramid and is made of transparent synthetic resin. Thus, the medicines passing through each hopper 25, 26 can smoothly drop downward even in a narrow space limited in a vertical direction. From the viewpoint of workability, the automatic medicine feed portion 5 and the manual medicine feed portion 6 are restricted as to their positions. Therefore, if a single hopper is disposed in the narrow space limited in the vertical direction, it is not possible to make the angle of the inner surface of the hopper large, resulting in difficulty in smoothly dropping the medicines. With the hoppers 25, 26 of the present embodiment, each hopper receives the dropped medicines within the extent of each limited area, enabling allowing the angle of the inner surface of each hopper to be made large enough.

The first hopper 25 is provided so as to correspond to both the feeder vessels 10 of the automatic medicine feed portion 5 in the 2 columns on the right side and the distributor boxes 24*a* of the manual medicine feed portion 6 on the right side. On the other hand, the second hopper 26 is provided so as to correspond to both the feeder vessels 10 of the automatic medicine feed portion 5 in the 3 columns on the left side and the distributor boxes 24*a* of the manual medicine feed portion 6 on the left side. Thus, even if the pyrazolone medicines remain in the inside of the first hopper 25, the nonpyrazolone medicines pass through the second hopper 26, preventing the pyrazolone medicines from adhering to the surface of the nonpyrazolone medicines. Therefore, it is possible to reliably deliver the nonpyrazolone medicine to the patient who is allergic to the pyrazolone medicines.

Figure 4:
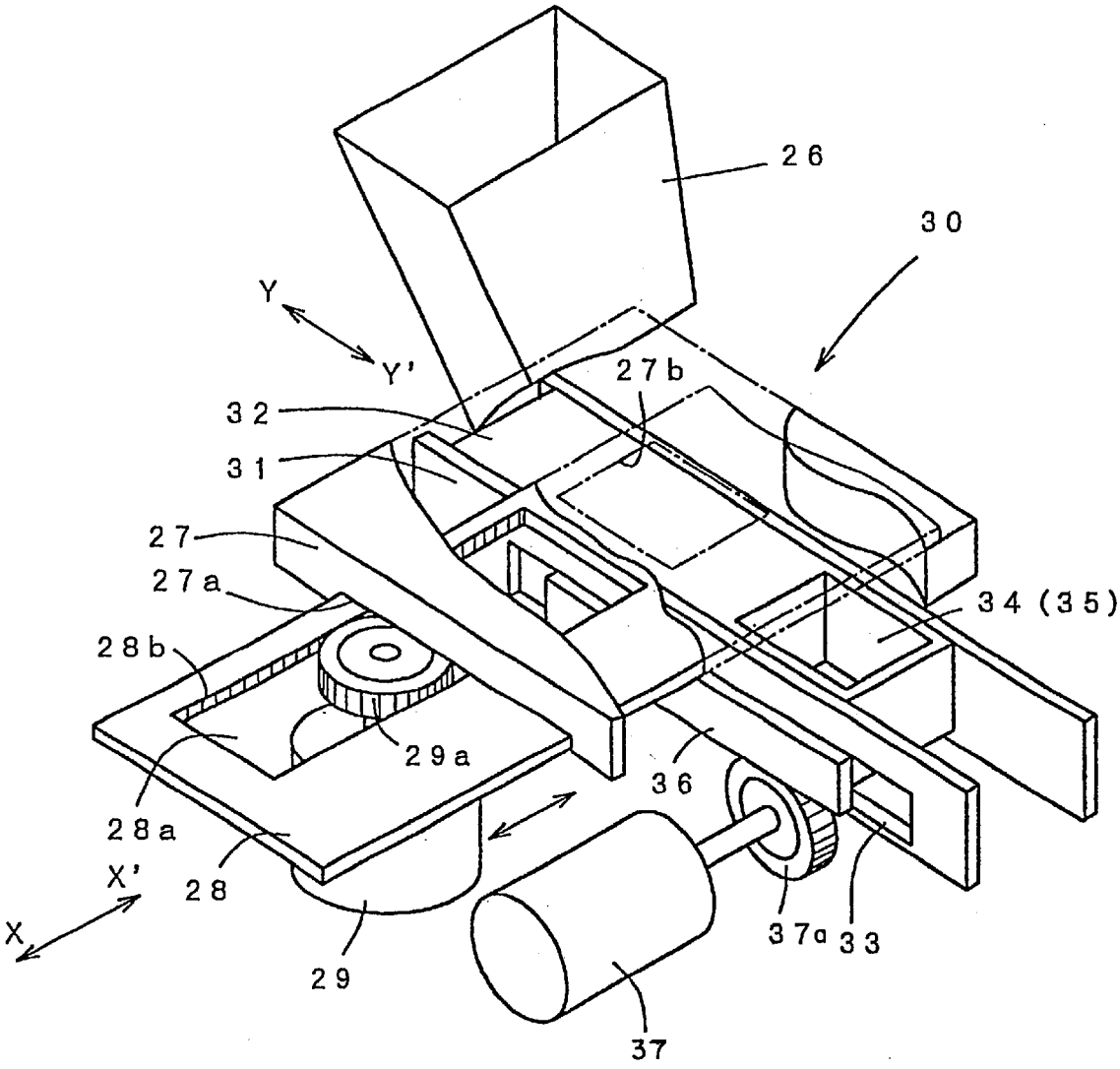
FIG. 4 is a perspective view showing a medicine delivery device of FIG. 1.

Beneath the second hopper 26, as shown in FIG. 4, there is disposed a shutter 28 which is slidably guided by a shutter guide 27. The shutter guide 27 has a plate-like shape. At the center of the lower surface of the shutter guide, a groove portion 27*a* for guiding both side portions of the shutter 28 is formed. On one end of the shutter guide 27 is formed a through hole 27*b* which is positioned beneath the lower opening of the second hopper 26. The shutter 28 has a plate-like shape with a thickness substantially the same as the depth of the groove portion 27*a*. The shutter 28 is formed with a rectangular aperture 28*a*. On an inner edge of the rectangular aperture 28*a* is formed a rack 28*b* which engages with a shutter gear 29*a*. Driving a shutter motor 29 to rotate the shutter gear 29*a* causes the shutter 28 to move in the directions X, X' shown in FIG. 4.

Under the shutter 28, there is disposed a medicine delivery device 30 comprising a delivery guide portion 31 and a delivery vessel 32 slidably guided by the delivery guide portion 31.

The delivery guide portion 31 has a substantially U-shape in its section and is formed with a long aperture 33 in one of the side walls thereof. On one end of the delivery vessel 32, there is formed a rectangular through hole 34 which opens in both upper and lower directions. The through hole 34 and the bottom of the delivery guide portion 31 define a delivery recess portion 35. On the side surface of the delivery vessel 32, there is formed a rack portion 36 laterally protruding through the long aperture 33 of the delivery guide portion 31. The rack portion 36 engages with a delivery gear 37 provided on a base. Driving a delivery motor 38 to rotate the delivery gear 37 causes the delivery vessel 32 to move in the directions Y, Y' as shown in FIG. 4.

On the other hand, beneath the first hopper 25 there is removably disposed a common hopper 38. The inside of the common hopper 38 is partitioned to form both a passage for the pyrazolone medicines and a passage for the nonpyrazolone medicines independently from each other. Alternatively, two hoppers of the same shape with no partition formed may be prepared as the common hopper 38 so that the hoppers can be replaced with each other in both the case of supplying the nonpyrazolone medicines through the medicine delivery device 30 and the case of supplying the pyrazolone medicines through the first hopper 25. The lower opening of the common hopper 38 is positioned on an opening of a medicine package produced by the medicine packing section 2.

Figure 5:
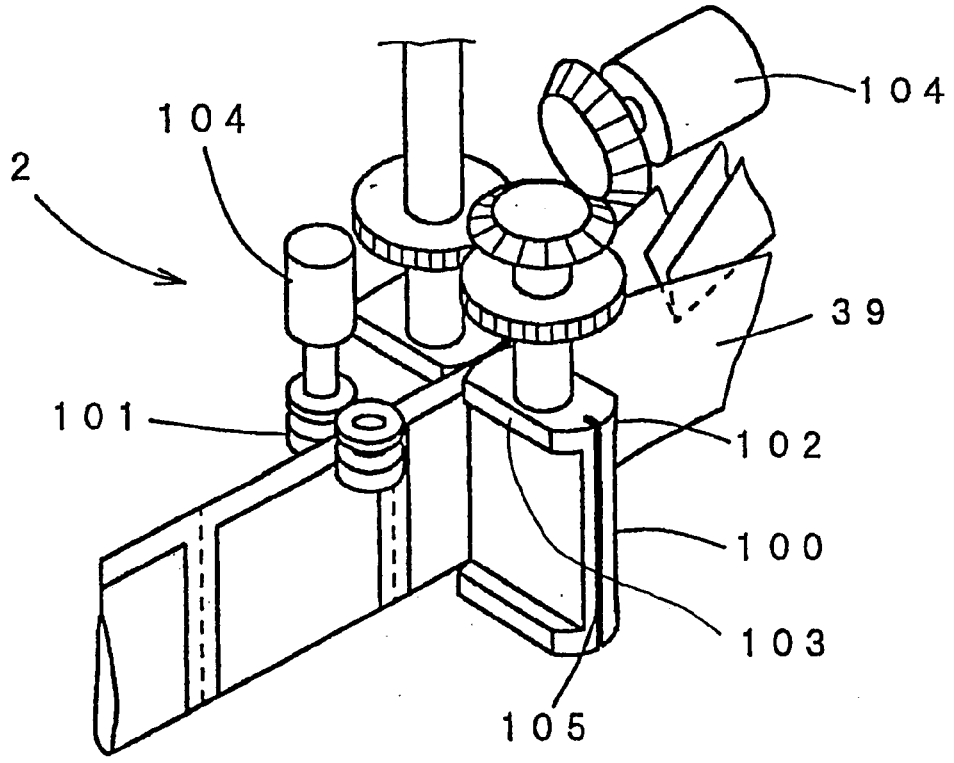
FIG. 5 is a perspective view showing a medicine packing section of FIG. 1.

The medicine packing section 2, as shown in FIG. 5, comprises a pair of cross heating heat rollers 100 and a pair of longitudinal heating heat rollers 101, which are disposed in a conveyance passage of a packing sheet 39. The cross heating heat rollers 100 are for heating the sheet in a sheet width direction, while the longitudinal heating heat rollers 101 are for heating the side edge of the sheet. The cross heating heat rollers 100 each have a cross heating surface 102 with a segment shape and a feed surface 103 with a straight shape. Each pair of rollers 100 and 101 is connected to a drive motor 104 via a transmission mechanism comprising gears. In the medicine packing section 2, the feed surfaces 103 of the cross heating heat rollers 100 are opposed to each other and the longitudinal heating heat rollers 101 are rotated. Then, the cross heating surfaces 102 of the cross heating heat rollers 100 are opposed to each other to seal the packing sheet 39. Thus, the size of the medicine package can be changed by properly adjusting the quantity of movement of the packing sheet 39 until it is sealed. At this time, roulette can be formed on the sealed medicine package by means of a roulette blade 105 provided on the cross heating surface 102 of the cross heating heat roller 100 (if necessary, refer to Japanese Laid-open patent publication 8-230832 and Japanese Laid-open patent publication 9-202301).

Figure 6:
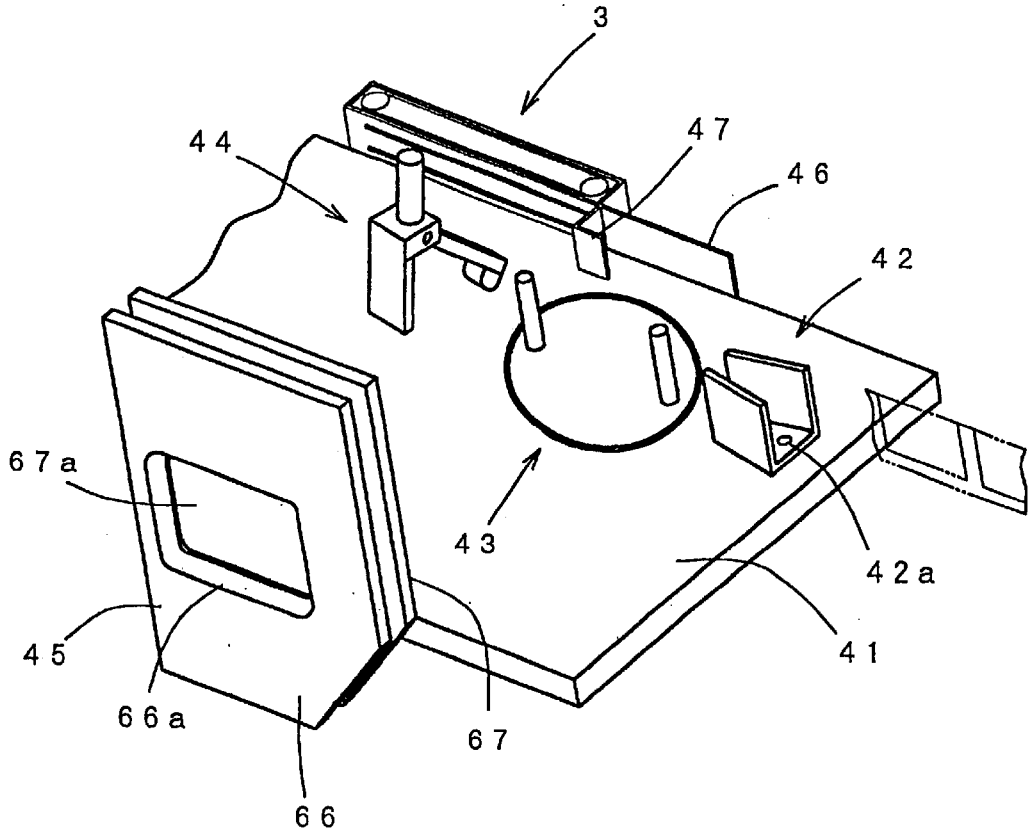
FIG. 6 is a perspective view showing a medicine package belt binding section of FIG. 1.

In the medicine package belt binding section 3, as shown in FIG. 6, a distributing member 42, a reel member 43, a gripping member 44 and a binding member 45 are provided on an inclined plate 41.

The inclined plate 41 is inclined obliquely downward along a moving direction of the formed medicine package belts. On the side edge of the inclined plate 41 are formed a guide wall 46 in a direction perpendicular to the surface of the inclined plate 41. On the guide wall 46, there is provided a guide piece 47 which is movable back and forth along the inclined direction of the inclined plate 41. The guide piece 47 has a substantially L-shape and protrudes from the guide wall 46 so that a short medicine package belt cut into a predetermined number of packages can be guided between the guide wall 46 and the guide piece 47. The guide piece 47 and the guide wall 46 have such a height that the medicine package belt protrudes from the upper edges thereof so as to be gripped by the gripping member 44.

The distributing member 42 is fabricated by bending a plate to be substantially U-shape in section. The distributing member 42 is mounted on the upper edge side of the inclined plate 41. The distributing member 42 is pivotable around a support shaft 42*a* by the rotation of a motor (unshown) so that the medicine package belt can be distributed in three directions in accordance with the packing configuration thereof in the medicine packing section 2. In the present embodiment, for example, the short medicine package belts cut into three-package units, and the long medicine package belts and the blank package belts can be distributed in three different directions, respectively. Namely, the short medicine package belts are distributed to the guide wall 46 and the guide piece 47, the long medicine package belts are distributed to the reel member 43 and the blank package belts are distributed to the binding member 45.

Figure 8:
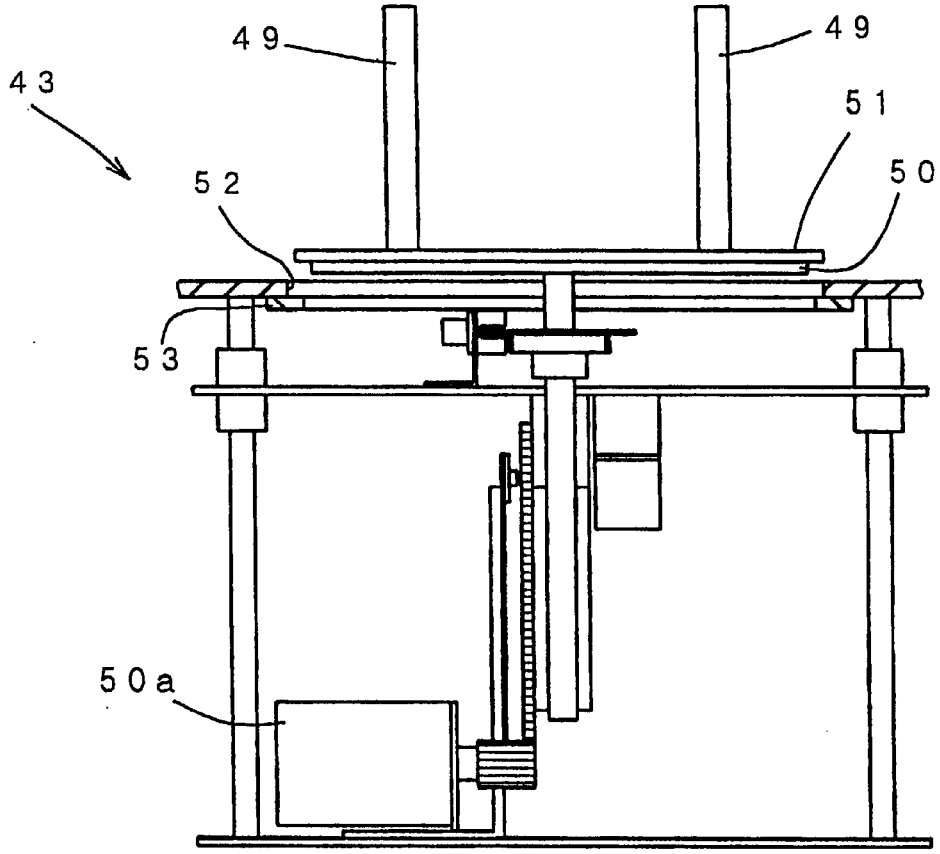
FIG. 8*a* is a front view showing a reel member of FIG. 6.
FIG. 8*b* is a plan view thereof.
Figure 8:
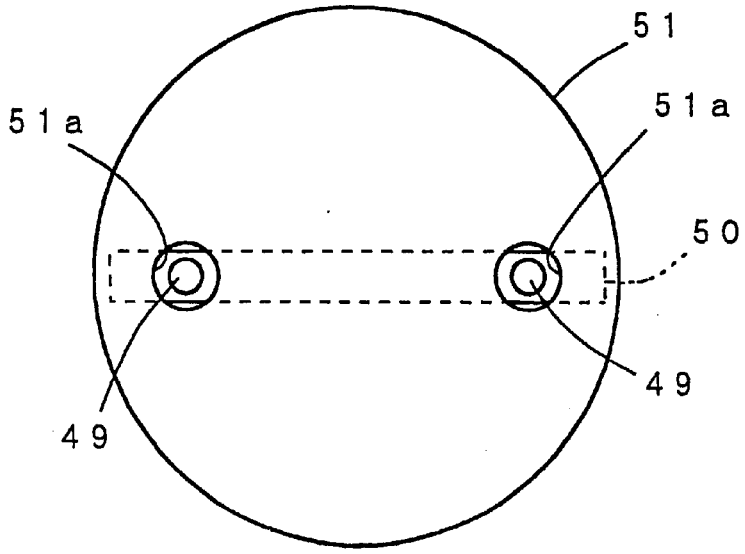

The reel member 43, as shown in FIG. 8, comprises a support portion 50 having guide shafts 49 in both end portions thereof. Each support portion 50 can be made to descend and ascend by means of a motor 50*a* and also to rotate by means of an unshown motor. A circular plate 51 having apertures 51*a* is rested on the support portion 50 so that the guide shafts 49 can slidably penetrate into the apertures 51*a*. The inclined plate 41 is formed with an opening portion 52 through which the support portion 50 descends and ascends. A stopper plate 53 is fixed on the lower inner periphery of the opening portion 52, which allows the support portion 50 to move downward and prevents the circular plate 51 from moving downward. In the reel member 43, the support portion 50 is rotated at the upper position to wind the medicine package belt around the guide shafts 49. Then, the support portion 50 is driven to descend so that the guide shafts 49 are released from the medicine package belt and the medicine package belt is supported on the circular plate 51. Thus, the medicine package belt wound by the reel member 43 can be smoothly conveyed only by gripping and turning the medicine package belt with the gripping member 44.

Figure 9:
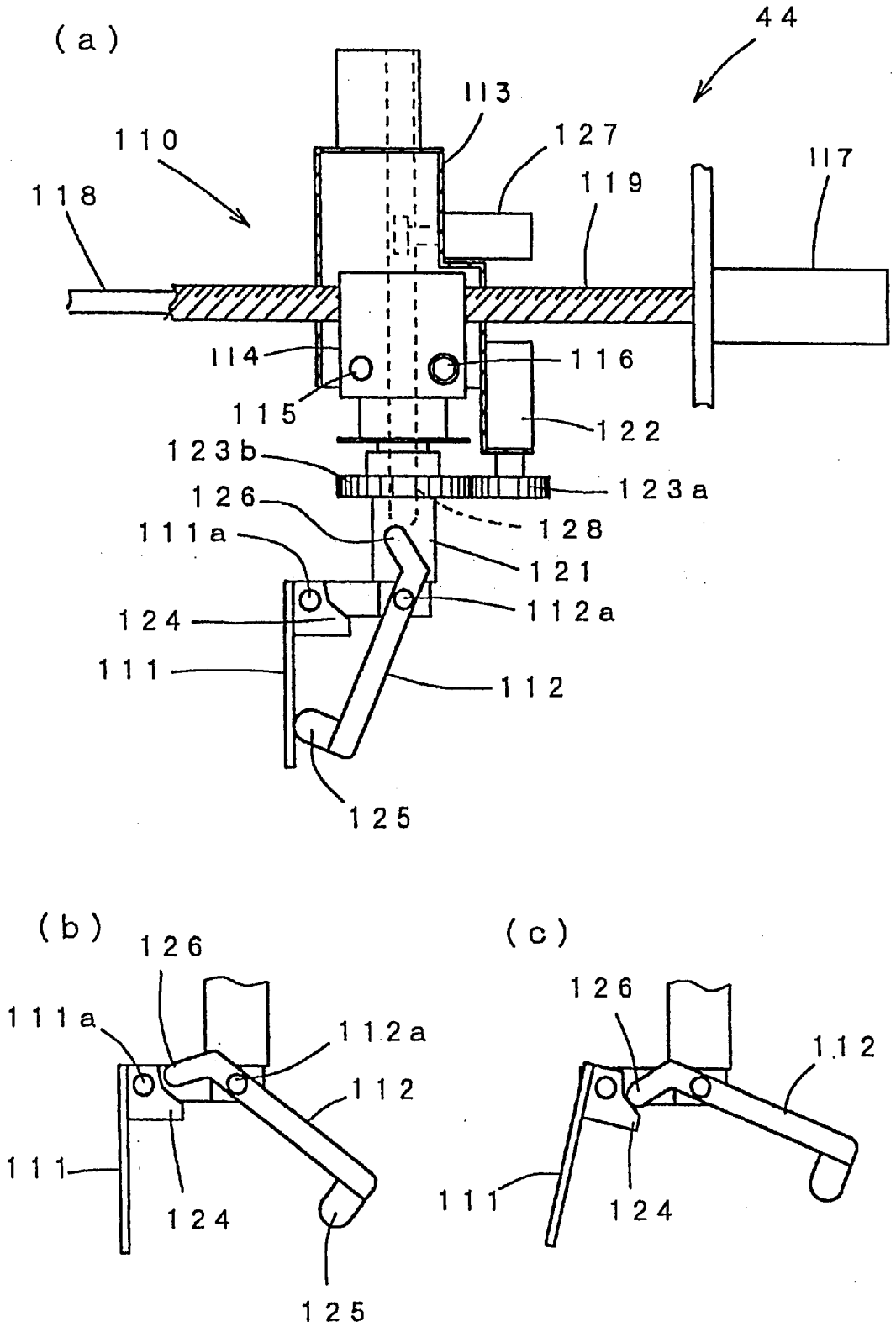
FIG. 9*a* is a front view showing a gripping member of FIG. 6.
FIG. 9*b* is a partial front view showing a first open condition.
FIG. 9*c* is a partial front view showing a second open condition.
Figure 10:
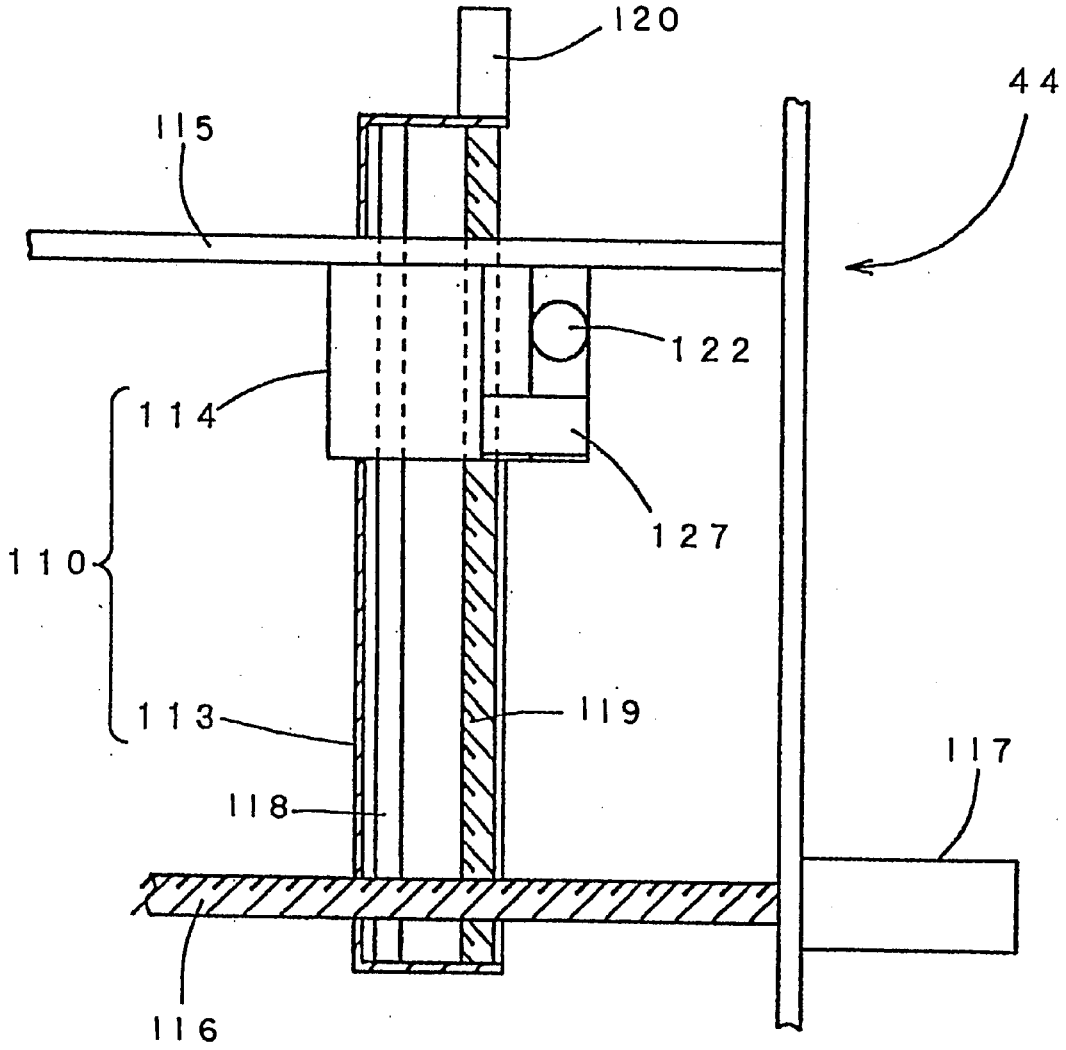
FIG. 10 is a plan view of FIG. 9*a;*

The gripping member 44, as shown in FIG. 9, is provided with a moving block 110, a first arm 111 and a second arm 112.

The moving block 110 comprises a first moving block 113 fabricated by bending a flat plate and a second moving block 114. The first moving block 113 is supported on a guide shaft 115 and a screw shaft 116 that are juxtaposed. When a motor 117 is driven to rotate the screw shaft 116, the first moving block 113 moves back and forth parallel to the inclined plate 41. In the same manner, the second moving block 114 is supported on a guide shaft 118 and a screw shaft 119 that are juxtaposed on the first moving block 113. When a motor 120 is driven to rotate the screw shaft 119, the second moving block 114 moves back and forth parallel to the inclined plate 41 in a direction perpendicular to the moving direction of the first moving block 113. Thus, the arms 111, 112 are movable to a guide position by the guide piece 47, a reel position by the reel member 43 and a binding position by the binding member 45.

The arms 111, 112 are pivotably mounted on one end of a rotation shaft 121, which is provided on the second moving block 114, around support shafts 11*a*, 112*a* respectively. Driving a motor 122 causes the arms 111, 112 to turn via gears 123*a*, 123*b*. The first arm 111 has a plate like shape and has a press receiving portion 124 adjacent to the support shaft 111*a*. The second arm 112 has a resilient projection 125 on a distal end thereof and a press portion 126 on a proximal end thereof. When a motor 127 is driven to extend a rod 128, the end of the rod 128 presses the side edge of the press portion 126 to pivot the second arm 112.

The arms 111, 112 are urged by an unshown spring so that the ends thereof move toward each other to grip the medicine package belt between the resilient projection 125 and the first arm 111. When the motor 127 is driven to cause the rod 128 to extend and then press the press portion 126 of the second arm 112, the arms 111, 112 pivot to a first open condition (refer to FIG. 9(*b*)) and a second open condition (refer to FIG. 9(*c*)). In the first open condition, only the second arm 112 pivots to separate from the first arm 111. In the second open condition, the second arm 112 further pivots to cause the first arm 111 to pivot and make the open angle large.

Figure 7:
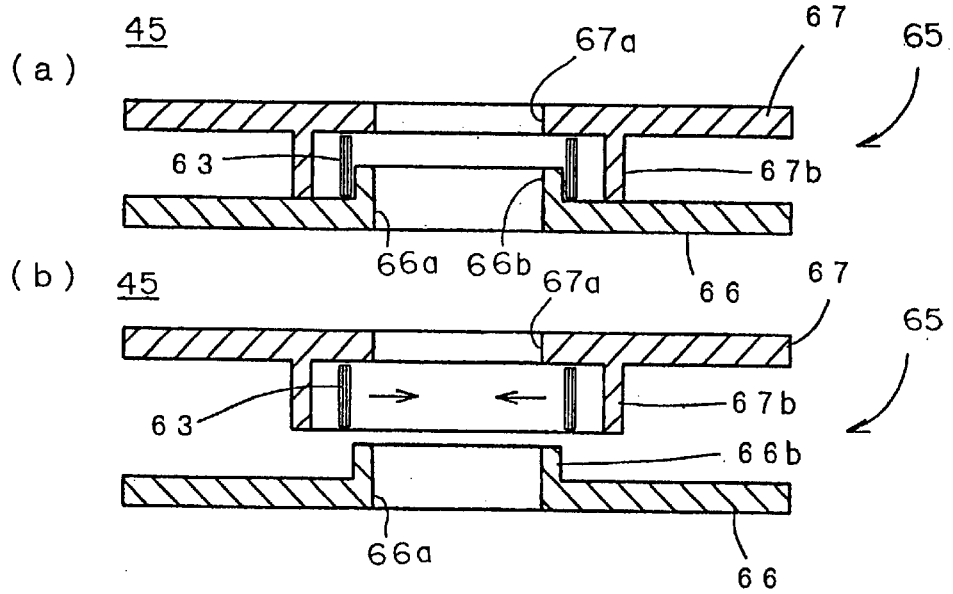
FIG. 7 is a sectional view showing a binding member of FIG. 1.

The binding member 45, as shown in FIGS. 1 and 7, is provided with a tape feed portion 64 for feeding a binding tape 63 and a guide member 65 for guiding the binding tape 63 fed from the tape feed portion 64 to make it circle. The guide member 65 comprises a first guide member 66 and a second guide member 67 which can approach and separate from each other in a direction of thickness. In the centers of the guide members 66, 67 are formed rectangular apertures 66*a*, 67*a* into which the medicine package belt gripped by the gripping member 44 is inserted. On the periphery of the rectangular aperture 66*a* of the first guide member 66 to formed an annular projection 66*b* toward the second guide member 67, while around the rectangular aperture 67*a* of the second guide member 67 is formed an annular projection 67*b* toward the first guide member 66. The annular projection 66*b* of the first guide member 66 is positioned inside the annular projection 67*b* of the second guide member 67. The projection dimension of the annular projection 66*b* of the first guide member 66 is half of that of the annular projection 67*b* of the second guide member 67. The space between the annular projection 66*b* and the annular projection 67*b* defines a guide passage for guiding the binding tape 63. The guide member 65 is provided with a heat-seal portion 68 for heat-sealing the binding tape 63 fed from the tape feed portion 64.

Next, operation of the aforementioned medicine packing apparatus will be explained.

In accordance with the prescription data from the host computer (unshown), the medicine feed section 1 feeds the corresponding medicines. If the medicines can be automatically fed, such medicines are discharged from the tablet feeder 8 of the automatic medicine feed portion 5, while if the medicines should be manually fed, such medicines are discharged from the manual medicine feed portion 6. The pyrazolone medicines are directly fed to the medicine packing section through the one passage of the common hopper 38 from the first hopper 25. The nonpyrazolone medicines are initially fed to the medicine delivery device 30 through the second hopper 26. In the medicine delivery device 30, the delivery motor 37 is driven to move the delivery vessel 32 in the direction of arrow Y whereby the medicines contained in the delivery vessel 35 are fed to the medicine packing section through the other passage of the common hopper 38. Thus, the passages are completely separated, eliminating the remaining powder or the like of the pyrazolone medicines from adhering to the nonpyrazolone medicines. In the case of using the hoppers without partition as the hopper 38, the hoppers are replaced with each other when supplying the nonpyrazolone medicines and when supplying the pyrazolone medicines.

The medicine packing section 2 packs the medicines fed from the medicine feed section 1 by individual dose. Namely, as the elongated packing sheet 39 is unwound and folded in two, the packing sheet 39 is sealed by the cross heating heat roller 100 at positions spaced in the longitudinal direction. When the medicines are received in the opening of the packing sheet 39 through the common hopper 38, the opening is sealed with the longitudinal heating heat roller 101. The medicine package belt with the medicines contained is cut with a cutter (unshown). In the case of an outpatient, the medicine package belt is cut into a units of one-week dosages (21 packages) to obtain long medicine package belts. In the case of an inpatient, the medicine package belt is cut into a units of one-day dosages (3 or 4 packages) to obtain short medicine package belts.

In the medicine package binding section 3, the medicine package belts are distributed by the distributing member 42 in accordance with the configurations thereof. The configuration of the medicine package belt is automatically decided based on the prescription data. For example, since the long medicine package belts are produced for the outpatient and the short medicine package belts are produced for the inpatient, the distribution direction of the distributing member 42 may be decided based on whether the medicine is for an outpatient or an inpatient.

Figure 11:
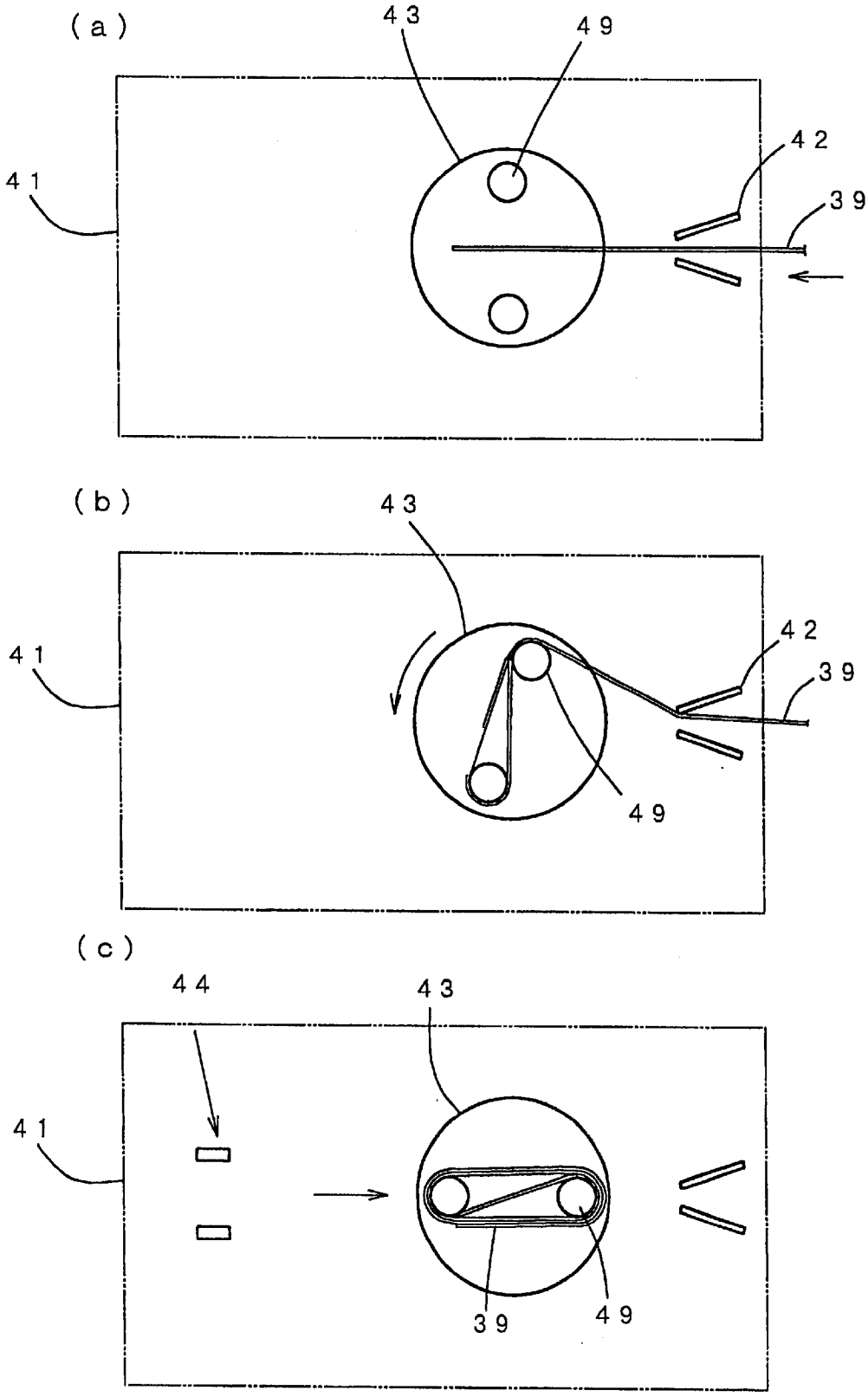
FIG. 11 is a schematic view showing a binding process for binding a long medicine package belt.

In the case of the long medicine package belts, as shown in FIG. 11(*a*), the distributing member 42 is positioned in a middle position so that the medicine package belt is moved straight along an inclination direction of the inclined plate 41. Then, as shown in FIG. 11(*b*), the reel member 43 is driven to wind the medicine package belt on the guide shafts 49. The reel member 43 is stopped when the guide shafts 49 are directed in the inclination direction of the inclined plate 41 and the terminal end of the medicine package belt is positioned at the downstream side of the reel direction with respect to the lower side guide shaft 49 as shown in FIG. 11(*c*). Thus, the terminal end of the medicine package belt wound on the reel member 43 is directed obliquely downwardly, making it difficult for the medicine package belt to be unwound.

Figure 12:
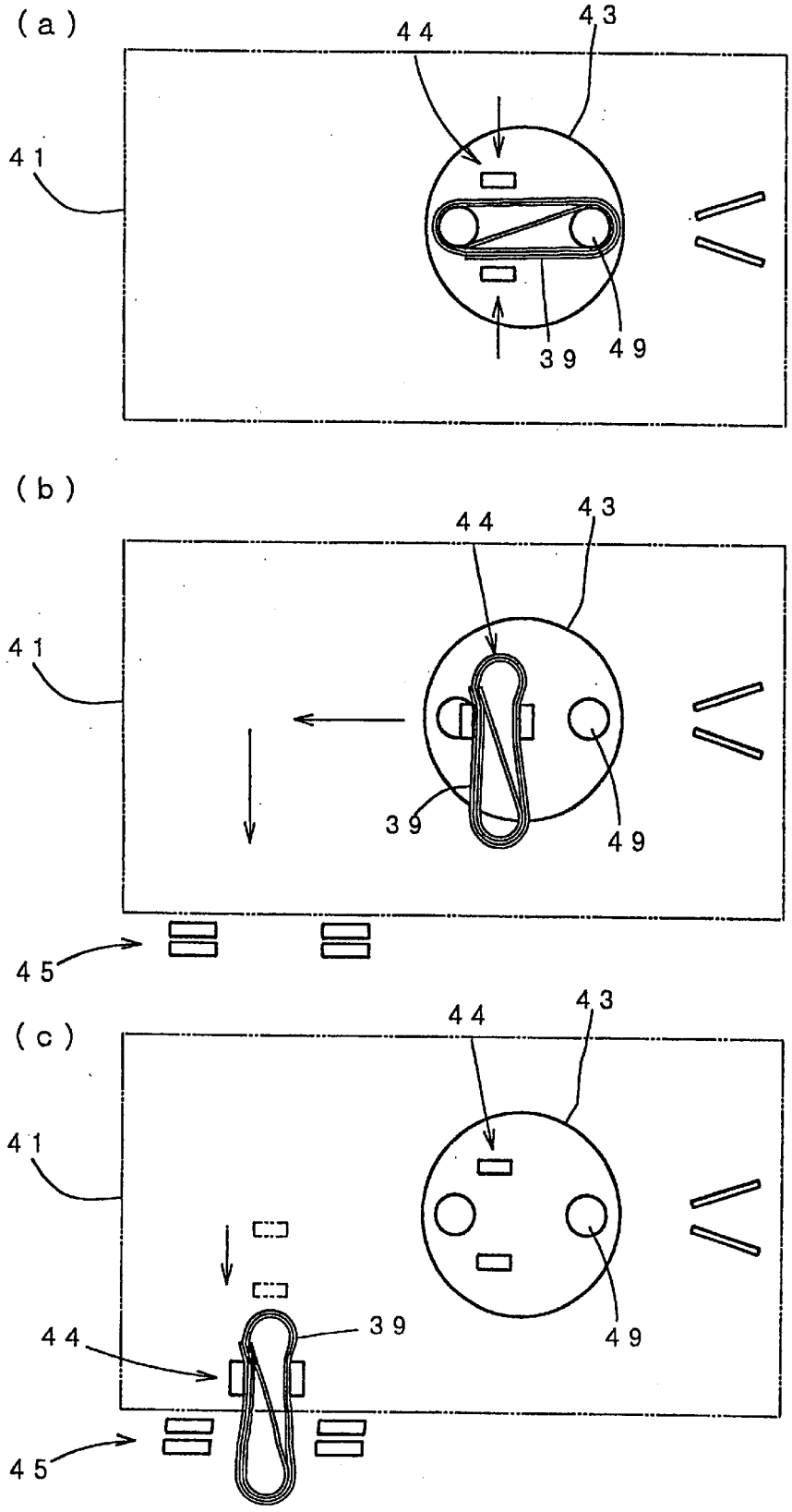
FIG. 12 is a schematic view showing a binding process for binding the long medicine package belt.

The gripping member 44 is positioned at an obliquely downward position with respect to the distributing member 42 and opened into the second open condition in advance. When finishing the winding of the medicine package belt, the gripping member 44 is moved upwardly along the inclined plate 41 as shown in FIG. 12(*a*). At the time when the arms 111, 112 pass by the lower-side guide shaft 49 and one positioned on both sides of the wound medicine package belt, the arms 111, 112 are operated to grip the medicine package belt. Then, as shown in FIG. 12(*b*), the reel member 43 is descended and then the gripping member 44 is pivoted and moved toward the binding member 45.

Consequently, as shown in FIG. 12(*c*), the center portion of the medicine package belt gripped by the gripping member 44 is positioned in the rectangular apertures 66*a*, 67*a* of the guide member 65 of the binding member 45. In detail, the medicine package belt is positioned so as to come into contact with the obliquely downwardly situated side edges of the rectangular apertures 66*a*, 67*a*. Then, the binding tape 63 is fed to the guide member 65 from the tape feed portion 64. The binding tape 63 goes around the guide passage of the guide member 65. At this time, the first guide member 66 is disengaged from the second guide member 67 and then the binding tape 63 is wound to bind the medicine package belt. Then, the overlapped portion of the binding tape 63 is heat-sealed by the heat-seal portion 68.

After that, the second arm 112 of the gripping member 44 is pivoted to the first open condition and the gripping member 44 is moved in the direction away from the binding member 45. Then, as shown in two-dot chain line in FIG. 12(*c*), the gripping member 44 is pivoted and moved so that the flat portion of the first arm 111 pushes the medicine package belt to discharge it through an unshown takeout port.

Figure 13:
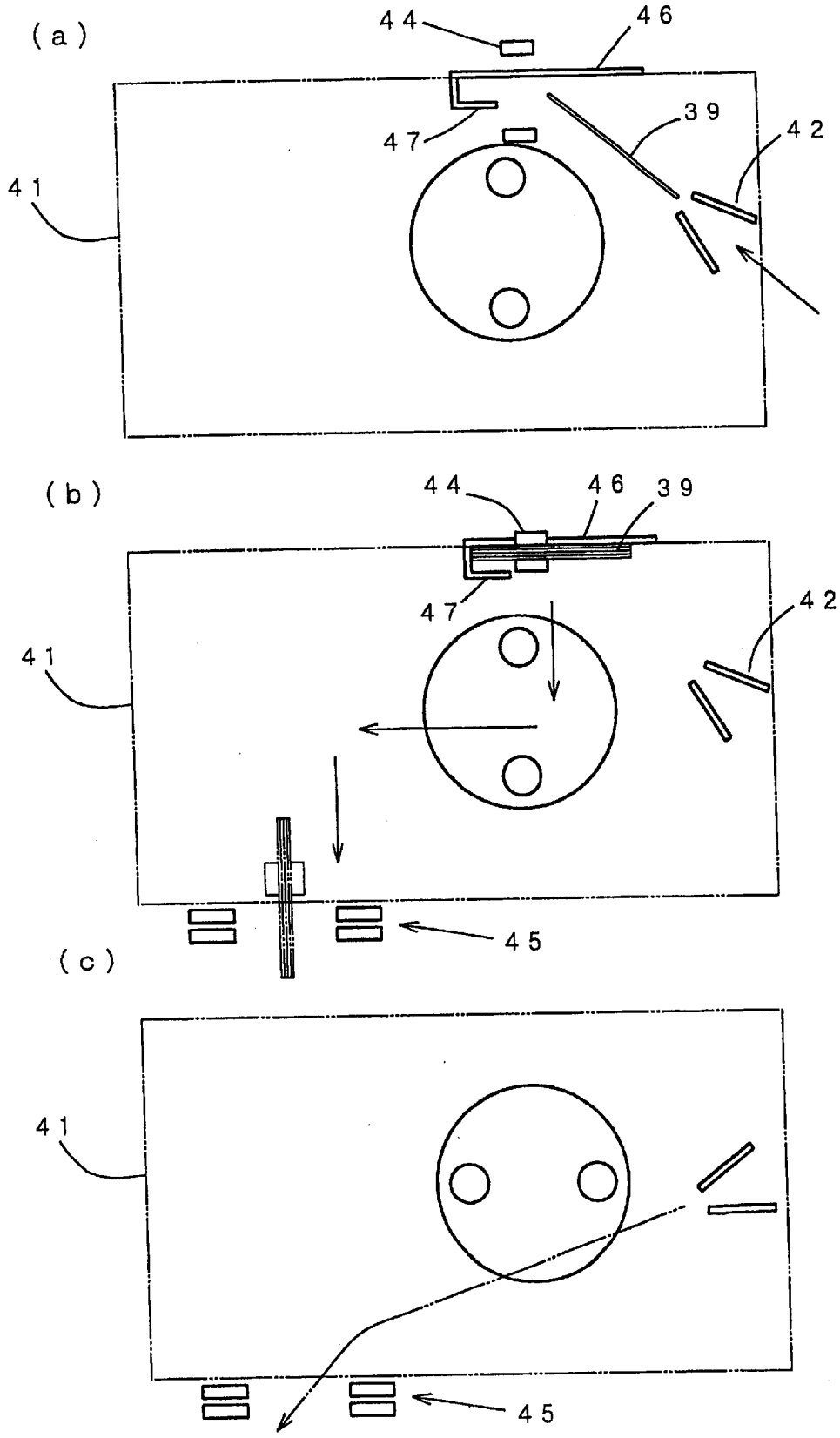
FIGS. 13*a* and 13*b* are schematic views showing a binding process of short medicine package belts.
FIG. 13*c* is a schematic view showing a discharging condition of blank package belts.

In the case of the short medicine package belts, as shown in FIG. 13(*a*), the distributing member 42 is pivoted to the guide wall 45 side. The guide piece 47 is moved in accordance with a cut length of the short medicine package belt. The gripping member 44 with the arms 111, 112 opened in the first open condition is moved to the vicinity of the guide piece 47. Each time the short medicine package belts are fed, the second arm 112 is pivoted to arrange the short medicine package belts along the guide wall 46. Thus, the short medicine package belts can be smoothly supplied. When the supply of the short medicine package belts is completed, as shown in FIG. 13(*b*), the short medicine package belts are gripped by the gripping member 44 and conveyed to the binding member 45 to bind the center portion of the short medicine package belts in the same manner as described above. After that, the bound short medicine package belts are discharged.

In the case of the blank package belts, as shown in FIG. 13(*c*), the distributing member 42 is pivoted to the binding member 45 side. The blank package belts are formed when continuous packaging is not preferred, such as the case of different patients and so on. For example, if the prescription data is different, it is decided that the blank package belts are to be formed, whereby the distributing member 42 is pivoted to the binding member 45 side. In the path to the rectangular aperture 66*a*, 67*a* of the binding member 45 from the distribution member 42, a guide passage may be preferably formed.

In the aforementioned embodiment, although two medicine feed passages are formed by the hoppers 25, 26, if three or more passages are necessary, hoppers with the number corresponding to that of the passages may be provided. In this case, as the medicine delivery device 30, for example, a belt conveyer or the like is preferably used.

As clear from the aforementioned explanation, according to the medicine packing apparatus of the present invention, the apparatus is provided with hoppers with at least two separated passages, and each hopper can feed a different kind of medicine. Thus, it can be reliably prevented that the medicines remaining in the hopper adhere to different kinds of other medicines. Moreover, it is possible to make the inclined angle of the inner surface of each hopper large, enabling reliable, smooth feeding of the medicines.

In addition, the detachable common hopper and the medicine delivery means are provided. Therefore, even if the number of the hoppers is increased in accordance with that of the medicine feeders, it is possible to easily feed the medicines to one place.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is

1. A medicine packing apparatus which feeds medicines in accordance with prescription data to distribute and pack the medicines by individual dose, wherein the apparatus is provided with first and second hoppers having two separated passages, wherein each of said first and second hoppers is arranged to feed a different kind of medicine, wherein a common hopper is provided between a medicine packing position and each of said first and second hoppers, wherein said common hopper is disposed directly beneath said first hopper such that said first hopper can directly feed the medicines to said common hopper, wherein said common hopper is not disposed directly beneath said second hopper such that said second hopper cannot directly feed the medicines to the common hopper, wherein a medicine delivery device for delivering the medicines from said second hopper to said common hopper is provided beneath a lower end of said second hopper, and wherein an inside of said common hopper is partitioned so as to include two separate passages for the different kinds of medicines.

2. The medicine packing apparatus as in claim 1, wherein said common hopper is detachably provided between the medicine packing position and each of said first and second hoppers.

3. The medicine packing apparatus as in claim 1, wherein said medicine delivery device is movably arranged beneath said lower end of said second hopper.

4. A medicine packing apparatus comprising:

a medicine feed section arranged to feed medicines in accordance with prescription data, said medicine feed section comprising a plurality of medicine feed portions arranged to feed different types of medicines, respectively;

a medicine packing section arranged to pack, by individual dose, the medicines fed from said medicine feed section;

a plurality of hoppers having a plurality of separated passages, said hoppers being disposed beneath said medicine feed section and being arranged to receive the different types of medicines from said medicine feed portions, respectively, and deliver the different types of medicines to said medicine packing section;

a medicine delivery device arranged beneath a lower end of said one hopper to deliver the medicine from said one hopper to said common hopper; and wherein said common hopper has a plurality of separated hopper portions to receive medicines from said plurality of hoppers, respectively.

5. The medicine packing apparatus as in claim 4, wherein said medicine delivery device is movably arranged beneath said lower end of said one hopper.

* * * * *

UNITED STATES PATENT AND TRADEMARK OFFICE

CERTIFICATE OF CORRECTION

PATENT NO. : 6,690,998 B1
DATED : February 10, 2004
INVENTOR(S) : Shoji Yuyama

It is certified that error appears in the above-identified patent and that said Letters Patent is hereby corrected as shown below:

Column 6,
Line 19, change “11a” to -- 111a --.

Signed and Sealed this

Twenty-second Day of June, 2004

JON W. DUDAS
*Acting Director of the United States Patent and Trademark Office*